US008334681B2

(12) United States Patent
Arigliano

(10) Patent No.: US 8,334,681 B2
(45) Date of Patent: Dec. 18, 2012

(54) DOMINO VOLTAGE REGULATOR (DVR)

(75) Inventor: Antonello Arigliano, Kaufering (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 392 days.

(21) Appl. No.: 12/658,930

(22) Filed: Feb. 17, 2010

(65) Prior Publication Data

US 2011/0193538 A1 Aug. 11, 2011

(30) Foreign Application Priority Data

Feb. 5, 2010 (EP) ..... 10368012

(51) Int. Cl.
*G05F 1/44* (2006.01)

(52) U.S. Cl. ..... 323/282

(58) Field of Classification Search ..... 323/265, 323/268, 269, 272, 274, 282, 284, 351
See application file for complete search history.

(56) References Cited

U.S. PATENT DOCUMENTS

| | | | | |
|---|---|---|---|---|
| 4,779,037 | A * | 10/1988 | LoCascio | 323/275 |
| 5,528,127 | A * | 6/1996 | Streit | 323/269 |
| 6,229,289 | B1 | 5/2001 | Piovaccari et al. | |
| 6,300,749 | B1 * | 10/2001 | Castelli et al. | 323/273 |
| 6,469,480 | B2 * | 10/2002 | Kanakubo | 323/269 |
| 6,493,242 | B1 * | 12/2002 | Riggio et al. | 363/16 |
| 6,509,722 | B2 * | 1/2003 | Lopata | 323/280 |
| 6,677,735 | B2 * | 1/2004 | Xi | 323/273 |
| 6,700,360 | B2 * | 3/2004 | Biagi et al. | 323/280 |
| 6,703,816 | B2 * | 3/2004 | Biagi et al. | 323/280 |
| 7,106,032 | B2 * | 9/2006 | Chen et al. | 323/269 |
| 7,521,909 | B2 | 4/2009 | Dow et al. | |
| 7,531,996 | B2 | 5/2009 | Yang et al. | |
| 7,656,224 | B2 * | 2/2010 | Perez et al. | 327/540 |
| 2006/0170401 | A1 | 8/2006 | Chen et al. | |
| 2008/0116862 | A1 | 5/2008 | Yang et al. | |
| 2009/0115382 | A1 | 5/2009 | Hasegawa et al. | |
| 2009/0189577 | A1 | 7/2009 | Lin et al. | |

OTHER PUBLICATIONS

European Search Report 10368012.0-1239, Jun. 18, 2010, Dialog Semiconductor GmbH.

"On-chip low drop-out voltage regulator with NMOS power transistor and dynamic biasing technique," by Gianluca Giustolisi et al., Analog Integrated Circuits and Signal Processing, Kluwer Academic Publishers, BO, vol. 58, No. 2, Nov. 26, 2008, pp. 81-91, XP019669004, ISSN: 1573-1979.

"New Design Method of Low Power Over Current Protection Circuit for Low Dropout Regulator," by Socheat Heng et al., VLSI Design, Automation and Test, 2009, VLSI-DAT '09, International Symposium on, IEEE, Piscataway, NJ, Apr. 28, 2009, pp. 47-51, XP031485226.

* cited by examiner

*Primary Examiner* — Adolf Berhane
(74) *Attorney, Agent, or Firm* — Saile Ackerman LLC; Stephen B. Ackerman

(57) ABSTRACT

A low dropout voltage regulator comprising a first output voltage regulation loop with a NMOS transistor as a pass element and a second output voltage regulation loop with a PMOS transistor as a pass element. The NMOS transistor is used for small current loads up to 1 mA, the PMOS transistor is used for higher current loads from 1 mA and up. A current sense buffer senses the current through the NMOS transistor and controls the gate of the PMOS transistor accordingly. Good load transient operation is achieved without the need of an external load capacitor.

25 Claims, 2 Drawing Sheets

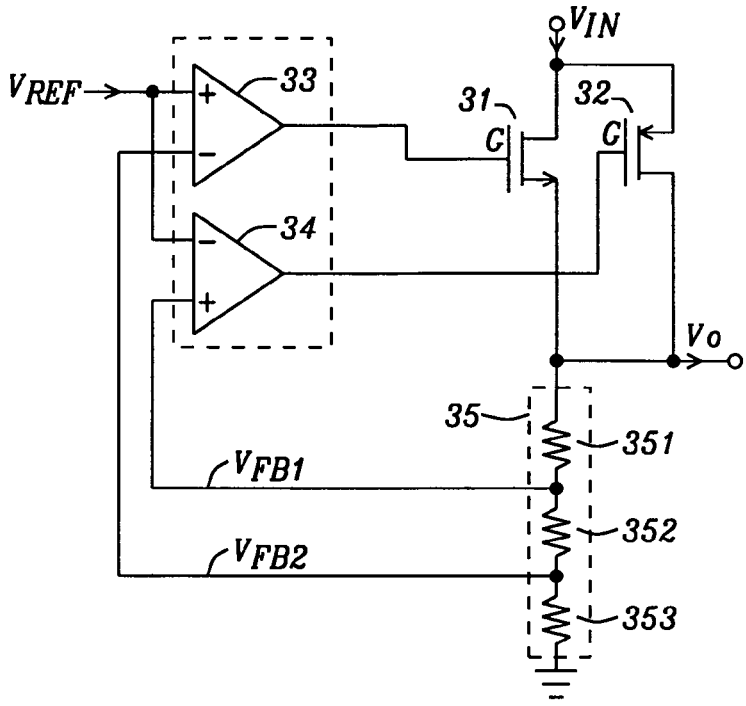
FIG. 1 – Prior Art
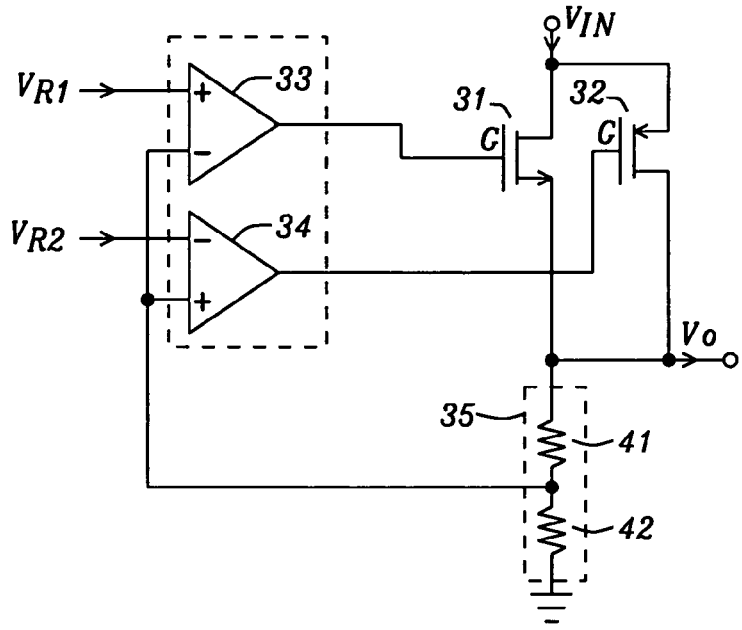
FIG. 2 – Prior Art

DOMINO VOLTAGE REGULATOR (DVR)

BACKGROUND OF THE INVENTION

1. Field of the Invention

The invention relates to DC/DC regulation using NMOS and PMOS transistors as pass devices, and more particularly to the use of two output voltage regulation loops, where a current sense buffer triggers the second voltage regulation loop.

2. Description of the Related Art

Linear regulators are used in many electronic devices and applications for converting an unregulated input voltage, typically a low voltage input, to a regulated output voltage. One particular implementation of a linear voltage regulator is referred to as a low dropout (LDO) regulator. Such a LDO regulator is a DC linear voltage regulator, it generally operates with a very small input-output differential voltage across the regulator and offers a well regulated voltage at its output terminal. Usually a LDO regulator consists of a feedback-controlled loop connected to a transistor (or transistors). The feedback-controlled loop typically comprises a differential amplifier (error amplifier). The feedback-controlled loop controls the gate voltage of the transistor and thereby its impedance. Depending on the gate voltage, the transistor supplies a different amount of current to the LDO's output terminal. The gate voltage is modulated such that the regulator provides a steady DC voltage regardless of load conditions or input transients.

FIG. 1 shows a circuit of the conventional art including an NMOS pass transistor 31 and a PMOS pass transistor 32, a voltage divider 35, and error amplifiers 33 and 34 using a common Vref input. NMOS pass transistor 31 and PMOS pass transistor 32 are coupled in parallel between voltage input Vin and voltage output Vo. Coupled between Vo and ground is voltage divider 35 with resistors 351, 352, and 353. The junction $V_{FB1}$ between resistors 351 and 352 is coupled to the +input of error amplifier 34. The junction $V_{FB2}$ between resistors 352 and 353 is coupled to the −input of error amplifier 33. The outputs of error amplifiers 33 and 34 drive the gate G of NMOS pass transistor 31 and PMOS pass transistor 32, respectively. The disadvantages of the circuit of FIG. 1 are: The circuit of FIG. 1, with the two feedback voltages $V_{FB1}$ and $V_{FB2}$, has the NMOS pass device always on when $V_{FB1}>V_{FB2}$. When $V_{FB2}\leqq V_{REF}$, the PMOS is turned on only when the output voltage Vo drops such that $V_{FB1}\leqq V_{REF}$. The disadvantage of this circuit is that it is very dependent on the offset of the two error amplifiers 33 and 34 and on the accuracy of the voltage divider 35 to minimize the output drop voltage necessary to turn the PMOS on. This circuit will basically have two possible output voltages Vo, depending on the output load current.

FIG. 2 is another circuit of the conventional art and similar to FIG. 1, except that two reference voltages VR1, VR2 and two resistors 41, 42 are used. Its disadvantages are: The circuit of FIG. 2 has only one feedback voltage but still two error amplifiers 33 and 34 to drive the NMOS 31 and PMOS 32 pass devices. The output voltage Vo is regulated in this case to the same value from the two error amplifiers 33 and 34 but a small offset between the two regulating (feedback) loops will make the circuit unstable.

U.S. patent applications and U.S. Pat. Nos. which have a bearing on the present invention are:

U.S. Patent Application 2009/0189577 (Lin et al.) describes an LDO linear regulator including a PMOS power transistor having a variable size, where its size is adjustable by a control signal. The control signal is an N-bit digital signal generated by an analog-to-digital converter. In addition a variable current source can be used, driven by the same analog-to-digital converter.

U.S. Patent Application 2009/0115382 (Hasegawa et al.) discloses a Low Drop-Out/Linear Drop-Out regulator having a PMOS output transistor Tr1, an error amplifier, a buffer amplifier and a drive capability adjustment transistor PMOS Tr3. A second PMOS transistor Tr2 provides feedback to the buffer amplifier.

U.S. Pat. No. 7,521,909 (Dow et al.) shows a linear regulator comprising a pass element, transistor 24, an error amplifier 23, a buffer 33, a sense network 28 (a voltage divider) and a Miller compensation circuit 40. Transistor 24 is formed to include a main transistor which forms a sense current that is representative of the current through transistor 24.

U.S. Pat. No. 6,229,289 (Piovaccari et al.) teaches a regulator which switches between a switched mode and linear regulator (LDO) mode. The linear regulator controls a first transistor coupled between input Vin and output Vout. The switched mode controller, a Pulse Width Modulation controller, controls a second transistor which, in series with an inductor, is also coupled between input Vin and output Vout.

U.S. Pat. No. 7,531,996 (Yang et al.) presents an LDO which includes an NMOS and a PMOS transistor coupled in parallel between supply power and output. First and second error amplifiers drive the NMOS and the PMOS transistor, respectively. A voltage divider provides the input(s) to the error amplifiers.

It should be noted that none of the above-cited examples of the related art provide the advantages of the below described invention.

SUMMARY OF THE INVENTION

It is an object of at least one embodiment of the present invention to provide a method and a circuit to minimize the dropout voltage of a transistor pass device in a low dropout voltage regulator, while accommodating low and high current loads.

It is another object of the present invention to provide a DC/DC regulator with good load transient regulation without the need of an external load capacitor.

It is yet another object of the present invention to provide good load transient response.

It is still another object of the present invention to provide chip area reduction.

It is a further object of the present invention is to provide a low quiescent current.

It is yet a further object of the present invention is to provide increased bandwidth of the regulation loop.

It is still a further object of the present invention is to require a much smaller compensation capacitor.

These and many other objects have been achieved by using a first and a second output voltage regulation loop where the first output voltage regulation loop uses an NMOS transistor as the pass device and the second output voltage regulation loop uses a PMOS transistor as the pass device. The NMOS transistor is used for small current loads up to 1 mA and the PMOS transistor is used for larger loads from 1 mA and up to maximum current load Imax. The first output voltage regulation loop comprises the NMOS transistor, a voltage divider and an error amplifier, the output of which drives the gate of the NMOS transistor. The second output voltage regulation loop comprises the PMOS transistor, the same voltage divider and error amplifier and a current sense buffer. One input of the current sense buffer couples to the output of the error amplifier. The other input of the current sense buffer senses the current through the NMOS transistor. The output of the error amplifier regulates the voltage at the gate of the NMOS transistor and the output of the current sense buffer regulates the gate voltage of the PMOS transistor when the current through NMOS transistor exceeds a specified threshold.

For low currents (1 mA or less) the NMOS transistor acts as source follower. The error amplifier and the NMOS transistor are the master of the output voltage regulation loop. For higher currents (1 mA or more) the NMOS transistor acts as a current source delivering the maximum current of 1 mA. The voltage at the gate of the NMOS transistor is frozen and the rest of the current is delivered by the PMOS transistor. The current sense buffer together with the PMOS transistor become the master of the regulation output voltage.

These and many other objects and advantages of the present invention will be readily apparent to one skilled in the art to which the invention pertains from a perusal of the claims, the appended drawings, and the following detailed description of the preferred embodiments.

In the following, first and second conductivity types are opposite conductivity types, such as NMOS (n-channel) and PMOS (p-channel) transistors.

BRIEF DESCRIPTION OF THE DRAWINGS

FIG. 1 is a first circuit diagram of a conventional LDO as described above.

FIG. 2 is a second circuit diagram of a conventional LDO as described above.

DESCRIPTION OF THE PREFERRED EMBODIMENT

Figure 3:
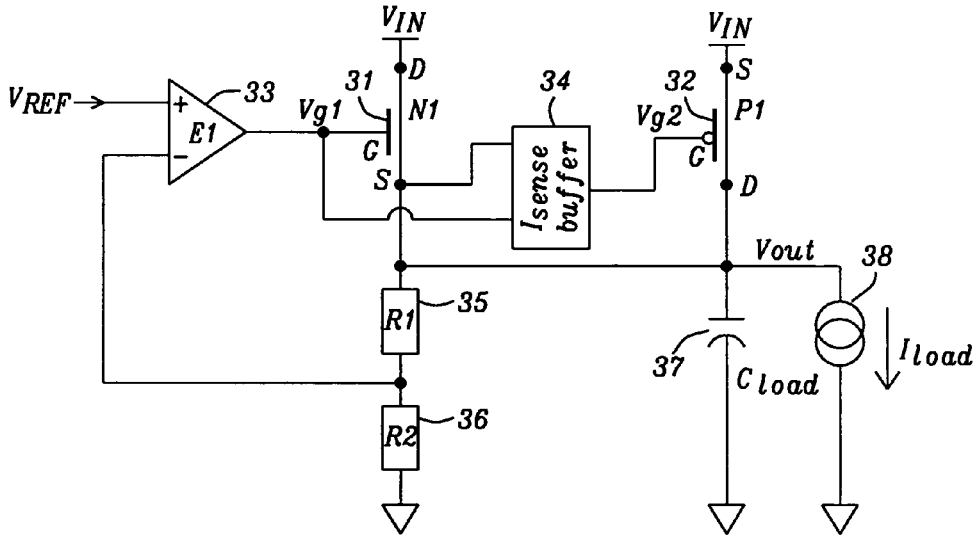
FIG. 3 is a circuit diagram of the preferred embodiment of the present invention.

Referring now to FIG. 3 we describe the preferred embodiment of the present invention. Domino voltage regulator 30 comprises an NMOS transistor 31 (N1), with gate G, source S and drain D, a PMOS transistor 32 (P1), with gate G, source S and drain D, an error amplifier 33 (E1), an Isense buffer 34, and voltage divider comprising resistors 35 (R1) and 36 (R2). The drain D and source S of transistor 31 (N1) are coupled between a positive power supply terminal with input voltage Vin and output voltage Vout. Similarly, source S and drain D of transistor 32 (P1) are coupled between input voltage Vin and output voltage Vout. Error amplifier 33 (E1) has its +terminal coupled to a reference voltage Vref and its output voltage Vg1 coupled to the gate G of transistor 31. A first input of Isense buffer 34 is coupled to source S of transistor 31, a second input of Isense buffer 34 is coupled to the output of error amplifier 33. The output of Isense buffer 34 (voltage Vg2) is coupled to the gate G of transistor 32. Resistors 35 and 36 are coupled between Vout and the power supply return terminal, typically ground. The junction of resistors 35 and 36 is coupled back to the −input of error amplifier 33. Also shown coupled to Vout are external capacitor 37 (Cload) and load current 38 (Iload).

In Domino voltage regulator 30, transistor 31 (N1) and transistor 32 (P1) are the pass devices. Transistor 31 is used for very small load currents, transistor 32 is used only for higher load currents in parallel with transistor 31. There are two output voltage regulation loop configurations:

the "low current loop", where error amplifier 33 and transistor 31 are the masters, and the "high current loop", where Isense buffer 34 and transistor 32 are the masters.

Domino voltage regulator 30 works as a DC/DC regulator, it has good load transient regulation response even when no external load capacitor 37 is used.

For small load current of between about 0 to 1 mA, transistor 31 is used and the load transient response is guaranteed by transistor 31 working as a source follower. In this configuration error amplifier 33 and transistor 31 are the master of the output voltage regulation loop.

For higher load currents of between about 1 mA and Imax, transistor 31 works as current source only, delivering its specified maximum current (about 1 mA in this case). Voltage Vg1, as applied to gate G of transistor 31 and to Isense Buffer 34, is fixed and the rest of the current is delivered by transistor 32. In this configuration, the Isense buffer 34 becomes together with transistor 32 the master of the regulation output voltage. The passing of the control from the low current loop to the high current loop is like one Domino piece affecting the next Domino piece. The load transient response as well as the increased band-width of the regulation loop is guaranteed in this case by transistor 32. This is guaranteed because in a standard linear regulator with a PMOS transistor as pass device, the load transient regulation is driven only by the regulation loop and its band-width. This means increasing the band-width improves also the load transient response. The band-width increase costs current, however this is not possible in a circuit where the quiescent current is required to be as small as possible, especially when the load current is close to zero. In the present circuit the regulation loop of the PMOS transistor starts to contribute when the load current is already sufficient high to make the band-width and the quiescent current increase acceptable. The limiting factor of this circuit is that the minimum output voltage Vout is limited by the threshold voltage Vth of NMOS transistor 31.

We now describe the function of Isense Buffer 34:

Assuming the NMOS pass device N1 contributes to the load Domino voltage regulator 30 up to 1 mA. The Isense Buffer 34 measures the current flowing in N1 by biasing another NMOS transistor, called $N_{Isense}$, with the same gate, source and drain voltage of N1, Vg1, $V_{out}$ and $V_{IN}$, respectively. Assume that $N_{Isense}$ is a factor 1/1000 smaller than N1. This means that when 1 mA current flows through N1, 1 uA current flows through $N_{Isense}$. A current comparator now compares the current flowing in $N_{Isense}$ to a constant bias current, 1 uA in this case. The output of this current comparator regulates the gate voltage Vg2, of the PMOS pass device P1.

In another description of the preferred embodiment of the present invention, and referring again to FIG. 3, the Domino voltage regulator 30 features:

1. A first output voltage regulation loop comprising a first switching means 31 (N1) of a first conductivity type, a first resistive means 35 (R1) and an amplifier 33 (E1), where an output (Vg1) of the amplifier is coupled to the control gate (G) of the first switching means, where the first output voltage regulation loop controls an output voltage at a junction Vout between the first switching means and the first resistive means, the first output voltage regulation loop controlling small currents of the first switching means.
2. A second output voltage regulation loop comprising a second switching means 32 (P1) of a second conductivity type, the first resistive means 35 (R1), the amplifier 33 (E1), and a current sense buffer 34 (Isense buffer), where an output of the current sense buffer (Vg2) is coupled to a control gate (G) of the second switching means, where the current sense buffer senses a current flowing in the first switching means and regulates the gate voltage of the control gate of the second switching means when the current flowing in the first switching means exceeds a specified threshold voltage, where the second output voltage regulation loop controls the output voltage at the junction Vout, the second output voltage regulation loop controlling large currents of the second switching means.

3. A second resistive means 36 (R2) coupled between a power supply return terminal (typically ground) and a first input (−) of the amplifier. The second input (+) of the amplifier is coupled to a reference voltage Vref.

The first switching means is a NMOS transistor having its drain-source path (D-S) coupled between power supply Vin and junction Vout. The second switching means is a PMOS transistor having its source-drain path (S-D) coupled between power supply Vin and junction Vout. The first resistive means is coupled between junction Vout and the first input (−) of amplifier 33 which has a minus polarity. The second input (+) of amplifier 33, which has a plus polarity, is coupled to reference voltage Vref.

A first input of current sense buffer 34 is coupled to the output of amplifier 33 and a second input of the current sense buffer is coupled to the source S of transistor 31 (equal to junction Vout). The output Vg2 of the current sense buffer is, as already mentioned earlier, coupled to the gate G of PMOS transistor 32. For small currents ranging from between about 0 mA and a maximum of about 1 mA, a load transient response is guaranteed by the first switching means working as a source follower where amplifier 33 and first switching means 31 are the master of the first output voltage regulation loop.

For high currents ranging from between about 1 mA and a maximum current Imax the first switching means acts as a current source only and delivers in this instant a maximum current of about 1 mA. At high currents, the voltage at the control gate G of first switching means 31 is fixed and currents ranging from about 1 mA to a maximum current Imax are delivered by second switching means 32; then current sense buffer 34 together with second switching means 32 become the master of the second output voltage regulation loop.

Switching means may imply devices such as a transistor or a transistor circuit, either of these in discrete form or in integrated circuits (IC), a relay, a mechanical switch. These devices are cited by way of illustration and not of limitation, as applied to switching means.

Resistive means may imply devices such as resistors, transistors or transistor circuits, either of these in discrete form or in integrated circuits (IC), functioning as resistors. These devices are cited by way of illustration and not of limitation, as applied to resistive means.

Advantages

Advantages of the present invention are:

Good load transient regulation without the need of an external load capacitor resulting in reduced cost to customer.

Area reduction of the IC die, because of the less critical stability of the Line regulators.

Miller compensation capacitors are not required.

Low quiescent current: this circuit optimizes the quiescent current required by a Line regulator which does not use an external load capacitor to improve its load transient response.

Eliminating the external load capacitors of the Line regulators has two main advantages:

One is application board related, because it cuts the costs and reduces the routing complexity. The other one is Silicon die area related. An external load capacitor at the Line regulator output introduces stability problems to the circuit witch need to be compensated by an internal Miller compensation capacitor to become stable.

Figure 4:
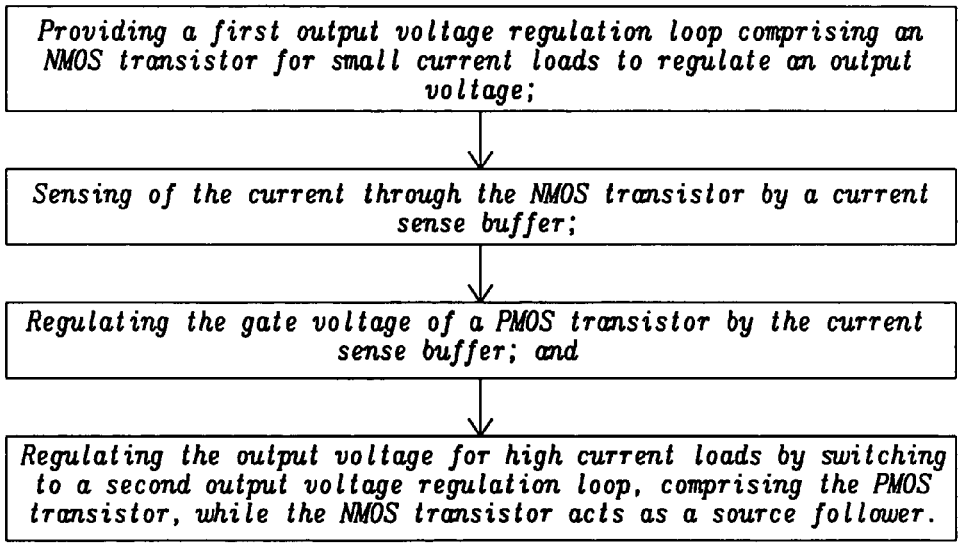
FIG. 4 is a block diagram of the preferred method of the present invention.

We now describe with reference to FIG. 4 a preferred method of providing a voltage regulator with a voltage regulation loop for small current loads and a voltage regulation loop for high current loads:

Block 1 provides a first output voltage regulation loop comprising an NMOS transistor for small current loads to regulate an output voltage;

Block 2 senses the current through the NMOS transistor by a current sense buffer;

Block 3 regulates the gate voltage of a PMOS transistor by the current sense buffer; and Block 4 regulates the output voltage for high current loads by switching to a second output voltage regulation loop, comprising the PMOS transistor, while the NMOS transistor acts as a source follower.

While the invention has been particularly shown and described with reference to the preferred embodiments thereof, it will be understood by those skilled in the art that various changes in form and details may be made without departing from the spirit and scope of the invention.

What is claimed is:

1. A voltage regulator, comprising:

a first output voltage regulation loop comprising a first switching means of a first conductivity type, a first resistive means and an amplifier, where an output of said amplifier is coupled to a control gate of said first switching means, where said first output voltage regulation loop controls an output voltage at a junction Vout between said first switching means and said first resistive means, said first output voltage regulation loop controlling small currents of said first switching means, where for said small currents a load transient response is guaranteed by said first switching means working as a source follower, where at large currents a voltage at said control gate of said first switching means is fixed and said first switching means acts as a current source only;

a second output voltage regulation loop comprising a second switching means of a second conductivity type, said first resistive means, said amplifier, and a current sense buffer, where an output of said current sense buffer is coupled to a control gate of said second switching means, where said current sense buffer senses a current flowing in said first switching means and regulates a gate voltage of said control gate of said second switching means by passing control from said first output voltage regulation loop to said second output voltage regulation loop when said current flowing in said first switching means exceeds a specified threshold voltage, where said second output voltage regulation loop controls said output voltage at said junction Vout, said second output voltage regulation loop controlling said large currents of said second switching means; and a second resistive means coupled between a power supply return terminal and a first input of said amplifier.

2. The voltage regulator of claim 1, wherein said first switching means is a NMOS transistor having a drain-source path, said drain-source of said NMOS transistor coupled between a power supply and said junction Vout.

3. The voltage regulator of claim 1, wherein
said second switching means is a PMOS transistor having a source-drain path, said source-drain of said PMOS transistor coupled between said power supply and said junction Vout.

4. The voltage regulator of claim 1, wherein
said first resistive means is coupled between said junction Vout and said first input of said amplifier, said first input of said amplifier having a minus polarity.

5. The voltage regulator of claim 1, wherein
a second input of said amplifier is coupled to a reference voltage, said second input of said amplifier having a plus polarity.

6. The voltage regulator of claim 1, wherein
a first input of said current sense buffer is coupled to said output of said amplifier and where a second input of said current sense buffer is coupled to said junction Vout.

7. The voltage regulator of claim 1, wherein
for small currents ranging from between about 0 mA and a maximum of about 1 mA, said amplifier and said first switching means are the master of said first output voltage regulation loop.

8. The voltage regulator of claim 1, wherein
for high currents ranging from between about 1 mA and a maximum current Imax, said first switching means delivers in this instant a maximum current of about 1 mA.

9. The voltage regulator of claim 8, wherein,
at said high currents a maximum current Imax is delivered by said second switching means.

10. The voltage regulator of claim 8, wherein,
at said high currents, said current sense buffer together with said second switching means become the master of said second output voltage regulation loop.

11. The voltage regulator of claim 8, wherein,
at said high currents, said second switching means guarantees a load transient response and increased band-width of said second output voltage regulation loop.

12. A voltage regulator, comprising:
a first output voltage regulation loop comprising an NMOS transistor having a drain-source path and a gate, a first resistive means and an amplifier, where an output of said amplifier is coupled to said gate of said NMOS transistor, where said first output voltage regulation loop controls an output voltage at a junction Vout between said NMOS transistor and said first resistive means, said first output voltage regulation loop controlling small currents of said NMOS transistor, where for small currents a load transient response is guaranteed by said NMOS transistor working as a source follower, where at large currents a voltage at said gate of said NMOS transistor is fixed and said NMOS transistor acts as a current source only;
a second output voltage regulation loop comprising a PMOS transistor having a source-drain path and a gate, said first resistive means, said amplifier, and a current sense buffer, where an output of said current sense buffer is coupled to said gate of said PMOS transistor, where said current sense buffer senses a current flowing in said NMOS transistor and regulates a gate voltage of said gate of said PMOS transistor by passing control from said first output voltage regulation loop to said second output voltage regulation loop when said current flowing in said NMOS transistor exceeds a specified threshold voltage, where said second output voltage regulation loop controls said output voltage at said junction Vout, said second output voltage regulation loop controlling said large currents of said PMOS transistor; and
a second resistive means coupled between a power supply return terminal and a first input of said amplifier.

13. The voltage regulator of claim 12, wherein
said first resistive means is coupled between said junction Vout and said first input of said amplifier, said first input of said amplifier having a minus polarity.

14. The voltage regulator of claim 12, wherein
a second input of said amplifier is coupled to a reference voltage, said second input of said amplifier having a plus polarity.

15. The voltage regulator of claim 12, wherein
a first input of said current sense buffer is coupled to said output of said amplifier and where a second input of said current sense buffer is coupled to said junction Vout.

16. The voltage regulator of claim 12, wherein
for small currents ranging from between about 0 mA to a maximum of about 1 mA, said amplifier and said NMOS transistor are the master of said first output voltage regulation loop.

17. The voltage regulator of claim 12, wherein
for high currents ranging from between about 1 mA to a maximum current Imax said NMOS transistor delivers in this instant a maximum current of about 1 mA.

18. The voltage regulator of claim 17, wherein,
a maximum current Imax is delivered by said PMOS transistor.

19. The voltage regulator of claim 17, wherein,
at said high currents, said current sense buffer together with said PMOS transistor become the master of said second output voltage regulation loop.

20. The voltage regulator of claim 17, wherein,
at said high currents, said PMOS transistor guarantees a load transient response and increased band-width of said second output voltage regulation loop.

21. A method of providing a regulated voltage, comprising the steps of:
a) providing a first output voltage regulation loop comprising an NMOS transistor for small current loads to regulate an output voltage guaranteeing a load transient response working as a source follower;
b) sensing of the current through said NMOS transistor by a current sense buffer;
c) regulating the gate voltage of a PMOS transistor by said current sense buffer; and
d) regulating said output voltage for high current loads by passing control from said first output voltage regulation loop to a second output voltage regulation loop, comprising said PMOS transistor, while the gate voltage of said NMOS transistor is fixed, said NMOS transistor acting as a current source only.

22. The method of claim 21, wherein
pass elements of the n- and PMOS transistors are coupled in parallel between a supply voltage and said output voltage.

23. The method of claim 21, wherein
for small current loads said first output voltage regulation loop is the master.

24. The method of claim 21, wherein
for high current loads said second output voltage regulation loop is the master.

25. The method of claim 21, wherein
first and second output voltage regulation loops have a common voltage divider.

* * * * *